United States Patent [19]

Helmig

[11] 4,178,850

[45] Dec. 18, 1979

[54] METHOD AND APPARATUS FOR OFFSET PRINTING EMPLOYING FLUOROELASTOMERS

[76] Inventor: Richard W. Helmig, Garrison Forest Rd., Owings Mills, Md. 21117

[21] Appl. No.: 785,956

[22] Filed: Apr. 8, 1977

Related U.S. Application Data

[63] Continuation of Ser. No. 602,908, Aug. 7, 1975, abandoned.

[51] Int. Cl.[2] ..... B41M 1/00

[52] U.S. Cl. ..... 101/451; 101/457; 101/465

[58] Field of Search ..... 101/450, 451, 462, 463, 101/473, 135, 136, 426, 213, 217, 174, 401, 495, 453, 454, 457, 465; 96/1.4, 1 R

[56] References Cited

U.S. PATENT DOCUMENTS

| | | | |
|---|---|---|---|
| 2,082,319 | 1/1937 | Barber | 101/174 |
| 2,894,452 | 7/1959 | Trisler | 101/136 |
| 3,049,996 | 8/1962 | Downie | 101/217 |
| 3,060,853 | 10/1962 | Remer | 101/426 |
| 3,203,346 | 8/1965 | Norton et al. | 101/217 |
| 3,554,836 | 1/1971 | Steindorf | 156/240 |
| 3,690,253 | 9/1972 | Dreyer | 101/217 |
| 3,802,952 | 4/1974 | Gurin et al. | 101/217 |
| 3,859,090 | 1/1975 | Yoerger et al. | 101/457 X |
| 3,901,700 | 8/1975 | Yoerger et al. | 96/1 R |
| 3,902,415 | 9/1975 | Fischer | 101/136 |

OTHER PUBLICATIONS

"The Technology of Litho Blankets", Sutton, The British Ink Maker, Feb. 1971 pp. 74, 76, 78, 80.

*Primary Examiner*—E. H. Eickholt

*Attorney, Agent, or Firm*—Burns, Doane, Swecker & Mathis

[57] ABSTRACT

An offset printing system and method wherein a plate cylinder, a blanket cylinder and ink applying means are arranged in cooperative relationship. The ink applying means applies ink to a plate removably carried by the plate cylinder and the ink applied to the plate is transferred as an image to an image receiving surface of a blanket secured to the blanket cylinder and having an image receiving surface comprising a solid fluoroelastomer. In the disclosed embodiment, the fluoroelastomer is a copolymer of vinylidene fluoride and hexafluoropropylene of a grade which remains solid and deforms elastically at temperatures in excess of 150° F. The fluoroelastomer has a specific gravity between about 1.82 and 1.86 and the ink applying means may also be provided with a surface comprising a fluoroelastomer which remains solid and deforms elastically at temperatures in excess of 150° F.

1 Claim, 2 Drawing Figures

METHOD AND APPARATUS FOR OFFSET PRINTING EMPLOYING FLUOROELASTOMERS

This is a continuation of application Ser. No. 602,908, filed Aug. 7, 1975 and now abandoned.

BACKGROUND OF THE INVENTION

The present invention relates to a printing machine and method and, more particularly, to a method and system for printing in accordance with offset printing techniques employing an intermediate medium referred to as a blanket to transfer an image from a printing plate to a sheet or web.

In printing machines of the type operating on an offset principal, ink is applied from an inking roller to a printing plate or other master mounted on a rotatable plate cylinder. A blanket mounted on a blanket cylinder adjacent the plate cylinder receives a film of ink in the form of an image from the plate cylinder as the plate or master is rotated in contact with the blanket. The image is then transferred to a sheet or web of material which passes between the blanket cylinder and an impression cylinder or platen.

The surfaces of the inking roller and the blanket employed in offset printing machines are typically composed of elastically deformable materials exhibiting good ink receptivity characteristics. For example, rubber and other suitable materials such as polyurethane and polyvinyl chloride have been employed for blankets and other ink receiving surfaces as is indicated in U.S. Pat. No. 3,765,329.

While acceptable results have been achieved using inking rollers and blankets having rubber or polymeric surfaces, numerous problems have also been encountered. For example, previously used materials provide relatively poor ink release and typically require complex or time consuming cleaning procedures to remove ink retained subsequent to the transfer process. A blanket having a rubber or other similar surface may, for example, retain as much as 50% of the ink film applied thereto when moved into contact with the sheet or web of material to which the image is being applied. Poor ink release not only detracts from the quality of the printing but also requires directing additional attention to the removal of the retained ink from the surface of the blanket.

Moreover, it is desirable that the blanket retain its elasticity so that the blanket does not become permanently impressed or engraved by the plate. Typical materials such as rubber now employed in the construction of blankets tend to swell due to the oils or other substances in the inks. The swelling of the blanket detracts from the printing properties of the blanket by, for example, increasing the printing pressure in one area and thereby causing the blanket to print heavier in that area than in other areas. Additionally, a swelling of the blanket reduces its strength and resiliency and the additional pressure between the blanket and both the plate and impression cylinders may cause the rubber surface to be engraved or otherwise damaged during the printing operation.

One attempt to obtain better ink release from a blanket in an offset printing machine has involved the use of polytetrafluoroethylene as the image receiving surface of the blanket. The use of polytetrafluoroethylene (e.g. Teflon ®) is disclosed in U.S. Pat. No. 3,164,087 as a means for reducing the residual image remaining on the surface of the blanket after the printing (i.e. a means for improving ink release). While the use of polytetrafluoroethylene may provide better ink release, this material deforms plastically, i.e. has no elastic memory, and therefore becomes engraved by the plate. In addition, ink applied to a polytetrafluoroethylene blanket tends to form globules instead of continuous film as is desirable for achieving maximum quality in printing. Polytetrafluoroethylene blanket and inking roller surfaces are also objectionable because the ink receptivity of the polytetrafluoroethylene is inferior to conventional materials such as rubber.

It is accordingly an object of the present invention to obviate the foregoing problems associated with the use of rubber, polyurethane, polytetrafluoroethylene, and the like for inking roller and blanket surfaces.

It is another object of the present invention to provide a novel method and printing apparatus wherein ink receiving surfaces are not subject to swelling, are highly receptive to conventional inks and exhibit desirable ink release characteristics.

It is a more specific object of the present invention to provide a novel offset printing method and blanket having an image receiving surface of a fluoroelastomer which does not swell or become tacky with prolonged use, has an elastic memory so that it does not readily become engraved, and yet exhibits excellent ink receptivity and release properties.

It is yet a further object of the present invention to provide a novel method and inking roller having the properties of the blanket of the foregoing object.

These and other objects and advantages of the present invention will become apparent to one skilled in the art to which the invention pertains from the following detailed description when read in conjunction with the appended drawings.

DETAILED DESCRIPTION

As will be appreciated by one skilled in the art to which the invention pertains, the invention may be employed in conjunction with various types of offset printing machines such as web or sheet feed lithographic offset printing presses or the like. One application of the invention to an offset printing machine is illustrated in FIG. 1.

Figure 1:
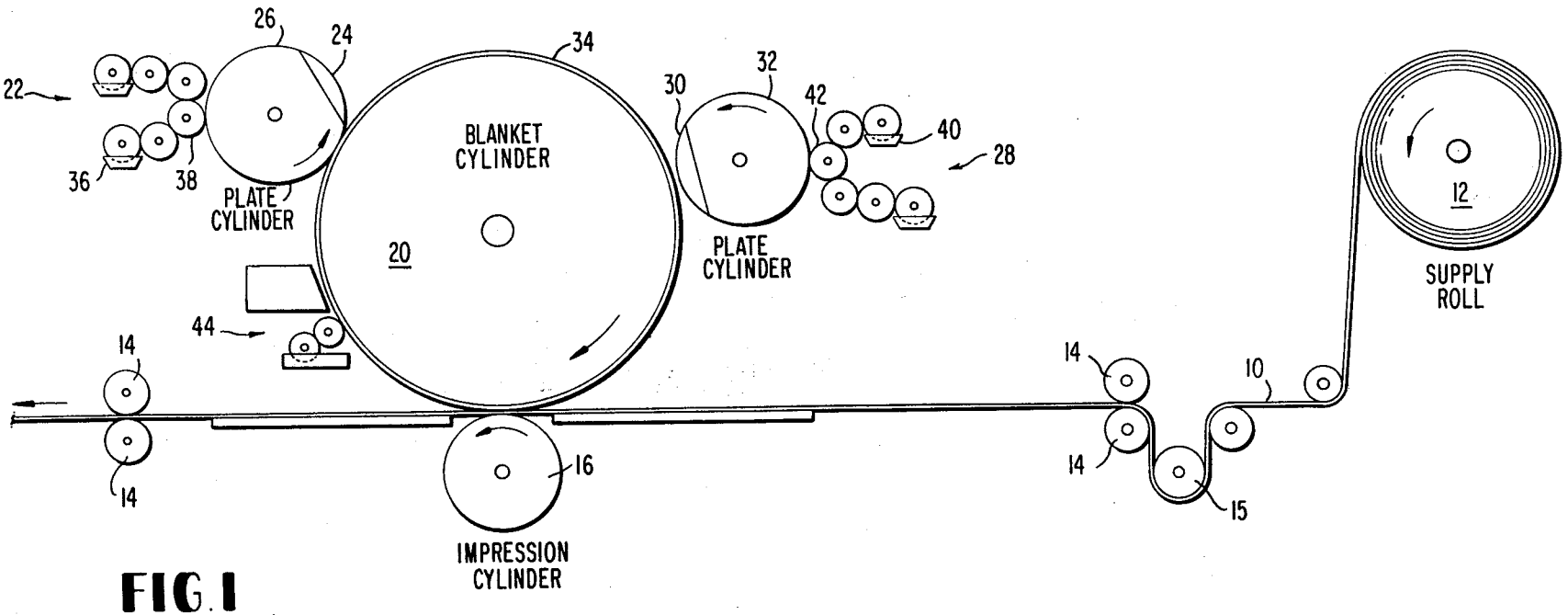
FIG. 1 is a schematic diagram of a typical offset printing machine embodying the principles of the present invention; and, FIG. 2 is a view in cross section of one embodiment of a blanket constructed in accordance with the present invention.

Referring now to FIG. 1, a continuous web of paper or other suitable stock generally indicated at 10 may be fed from a supply roll 12 through feed rollers 14 including an idler or take-up roller 15. The web is fed between an impression cylinder 16 and a blanket cylinder 20 where an image is transferred to the web as is discussed hereinafter. An inking station including ink and water applying rollers generally indicated at 22 may apply ink to a printing plate 24 carried by a plate cylinder 26. A second inking station 28 may also be provided to apply ink to a second printing plate 30 carried by a second plate cylinder 32.

At least one blanket 34 is carried by the blanket cylinder 20 and is secured thereto in a suitable manner. For example, the blanket 34 may be secured to the blanket cylinder 20 in a manner illustrated in U.S. Pat. No. 3,869,985 assigned to the assignee of the present invention. The blanket 34 receives one or more images from the plates 24 and 30 as the plates rotate into contact with the blanket. As the web 10 advances through the printing machine between the blanket 34 and the impression cylinder 16, an image is repetitively transferred from the blanket 34 to the web 10. Where two plate cylinders and inking stations are provided as in the embodiment illustrated in FIG. 1, the image may be a multicolored image.

For example, ink of one color may be supplied from an ink fountain 36 of the ink applying station 22 to an inking roller 38 which contacts the plate 24 as the plate cylinder 26 rotates. An etched or otherwise suitably formed surface of the plate 24 picks up a film of ink from the inking roller 38 on selected areas thereof, e.g., raised areas of the plate. The flm of ink deposited on the plate 24 is then transferred to the blanket 34 as the plate 24 rotates into contact with the blanket 34. Similarly, a second color of ink may be supplied from an ink fountain 40 of the ink applying station 28 to an inking roller 42 which contacts the plate 30 as the plate cylinder 32 rotates. The register of the plate cylinders 26 and 32 may be such that the image transferred from the plate 30 to the blanket 34 is appropriately aligned with the image transferred to the blanket 34 previously from the plate 24. Thus, a multicolored image may be transferred to the blanket 34 from the plates 24 and 30.

The film of ink deposited on the blanket 34 in the form of images from the plates 24 and 30 is then transferred from the blanket 34 to the web 10 as the web passes between the blanket 34 and the impression cylinder 16. A blanket washing and drying station generally indicated at 44 may then remove any residual ink retained by the blanket 34 subsequent to the transfer of the image to the web 10.

As the blanket 34 rotates into contact with the plates 24 and 30 and with the impression cylinder 16, a certain degree of pressure is exerted on the blanket 34 by the plates 24 and 30 and the impression cylinder 16. The degree of pressure is typically controlled in order to control the quality of the resultant printing on the web 10. Accordingly, it will be appreciated that the blanket 34 must deform elastically so as to prevent any damage thereto. Moreover, it will be appreciated that any swelling of the blanket 34 will cause increased pressure between the blanket 34 and the plate and impression cylinders.

In addition, it will be appreciated that the blanket 34 must exhibit good ink receptivity properties, i.e., must readily receive ink from the plates 24 and 30 in the form of a film without forming globules of ink in the imprinted areas. As the blanket 34 contacts the web 10, the blanket 34 should additionally release a major portion of the ink forming the image onto the web 10.

In accordance with the present invention, the image receiving or outer surface of the blanket 34 is composed of a solid fluoroelastomer which is highly resistant to swelling, exhibits the required elastic properties and exhibits desirable ink receptivity and release properties. More particularly, the image receiving surface of the blanket is preferably composed of a fluoroelastomer which remains solid and deforms elastically at temperatures in excess of the highest temperatures encountered at the surface of the blanket, e.g. 150° F. in typical printing applications.

The blanket may be constructed in accordance with conventional techniques and may be, for example, a single layer sheet of the solid fluoroelastomer material or of conventional laminated construction. The dimension of the blanket depends, of course, on the printing machine with which the blanket is being used. A typical blanket thickness may, for example, range from 0.030 to 0.140 inches.

Figure 2:
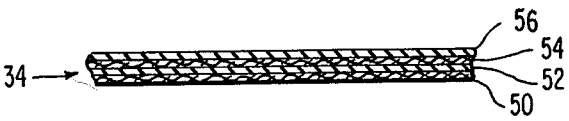

One embodiment of a blanket constructed in accordance with the present invention is illustrated in FIG. 2.

Referring now to FIG. 2, the illustrated blanket may comprise a laminated arrangement comprising several layers designated 50–56. The layers 50 and 54 may be, for example, canvas or other suitable woven fabric material. The layer 52 intermediate the layers 50 and 54 may be rubber or other suitable elastically flexible material bonded to the layers 50 and 54 in a suitable manner.

The outer, image receiving surface of the blanket is provided by the layer 56 bonded to the layer 54. The layer 56 is a solid fluoroelastomer and, in the layered blanket embodiment of FIG. 2, may be applied to the base layers 50–54 through any suitable technique such as molding or calendering. The fluoroelastomer layer 56 is preferably at least about 0.005 inches in thickness and the overall thickness of the blanket may range between about 0.030 to 0.140 inches (depending upon the machine with which the blanket is intended to be used).

In accordance with a preferred embodiment of the invention, the solid fluoroelastomer providing the image receiving surface of the blanket is composed of Viton® fluoroelastomer commercially available from DuPont. Viton fluoroelastomers are a series of fluoroelastomers based on the copolymer of vinylidene fluoride and hexafluoropropylene with the repeating structure possibly—$CF_2$—$CH_2$—$CF_2$—$CF(CF_3)$—.

Viton fluoroelastomer is a silver-gray translucent solid with a specific gravity ranging from about 1.72 to 1.86 depending on the grade. This material provides excellent corrosion resistance to the ingredients typically employed in ink and solvents used in printing. In air, Viton grades A,A-35, A-HV and B remain usefully elastic for indefinite periods of exposure at elevated temperatures well in excess of 150° F., e.g., temperatures up to 400°–450° F. Moreover, Viton fluoroelastomer exhibits excellent ink receptivity and release properties when used either as the inking surface of inking rollers or as the image receiving surface of a blanket.

As to ink release properties, for example, it has been found that a major portion of the ink film is released from the blanket 34 to the surface of the web 10 (FIG. 1) when using a blanket having a Viton fluoroelastomer outer surface. It is believed that as much as 0.045 inch of ink of an overall 0.050 inch film is released and transferred to the web, thus leaving only a 0.005 inch film of ink on the blanket. This amounts to a 90% ink release as compared to about 50% with some rubber blanket surfaces.

The corrosion resistant properties of Viton fluoroelastomer prevent swelling of the blanket and inking rollers thereby materially reducing any possibility of surface damage or faulty printing. Viton fluoroelastomer is also desirably elastically deformable and remains so at elevated temperatures. Moreover, the ink applied to the Viton fluoroelastomer surface does not form globules such as has been experienced with other materials.

One blanket of a laminated construction with an outer, image receiving surface of Viton B fluoroelastomer has been shown to possess the above desirable qualities. Viton B fluoroelastomer has a specific gravity of about 1.86 and provides a compression set resistance superior to other grades. However, Viton A fluoroelastomer having a lower specific gravity of about 1.82 is also suitable for the ink receiving surfaces of rollers and blankets in offset printing machines.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method of lithographic printing comprising the steps of:

applying ink to a surface of a roller provided with a solid fluoroelastomer surface;

contacting a printing plate carried by a plate cylinder with water to apply water to the plate and with a surface of the roller to apply a film of ink to the plate from the roller;

moving the water and the ink bearing printing plate into contact with an image receiving surface of a transfer medium consisting essentially of a solid fluoroelastomer image receiving surface to transfer the film of ink in the form of an image from the printing plate to the image receiving surface of the transfer medium, the fluoroelastomer being resistant to swelling in lithographic printing and having ink receptivity sufficient to receive the ink from the plate in the form of a film without forming globules of ink in imprinted areas, and having ink release sufficient to release a major portion of the ink during subsequent transfer of the image from the blanket; and transferring a major portion of the film of ink from the image receiving surface to another surface;

and wherein the fluoroelastomer image receiving surface of the transfer medium and the fluoroelastomer surface of the roller are each a copolymer of vinylidene fluoride and hexafluoropropylene.

* * * * *